United States Patent [19]

Pamplin

[11] 4,257,564

[45] Mar. 24, 1981

[54] APPARATUS AND METHOD FOR CRUSHING MATERIAL

[76] Inventor: James B. Pamplin, 11612 Morgan La., Garden Grove, Calif. 92640

[21] Appl. No.: 65,060

[22] Filed: Aug. 9, 1979

[51] Int. Cl.[3] ..... B02C 7/10

[52] U.S. Cl. ..... 241/30; 241/252; 241/253

[58] Field of Search ..... 241/30, 252, 253, 254, 241/220, 32, 37, 206, 262; 184/1 R

[56] References Cited

U.S. PATENT DOCUMENTS

| | | | |
|---|---|---|---|
| 2,172,704 | 9/1939 | Gentilli | 241/252 X |
| 2,884,036 | 4/1959 | Symons | 241/252 X |

*Primary Examiner*—Mark Rosenbaum
*Attorney, Agent, or Firm*—Gordon L. Peterson

[57] ABSTRACT

A crushing apparatus comprising first and second crushing jaws with each of the crushing jaws having a crushing surface. The crushing surfaces are arranged to define an acute angle no larger than about 45 degrees and to at least partially define a crushing cavity for receiving material to be crushed. The crushing jaws are relatively moved along a path generally parallel to the crushing surface of the first jaw so that the spacing between the crushing surfaces does not vary with the relative movement of the jaws. The relative movement between the jaws can be linear or rotational.

21 Claims, 5 Drawing Figures

APPARATUS AND METHOD FOR CRUSHING MATERIAL

BACKGROUND OF THE INVENTION

This invention relates to a crusher of the type which can be used for crushing various material, such as rock. Crushers typically employ at least two jaws which define a crushing cavity for receiving the material to be crushed. The jaws are moved toward and away from each other to vary the cavity dimensions to apply compressive loads to the material in the cavity to crush such material. The jaws can be moved toward each other by reciprocating one of the jaws as shown, for example, in Lipsey U.S. Pat. No. 203,054 or Low U.S. Pat. No. 350,494. The jaws can be opened and closed utilizing various forms of rotary motion as shown, for example, by Hack U.S. Pat. No. 2,607,539 and various kinds of cone crushers which employ cone-shaped rotary jaws. Also, the opening and closing motion of the jaws can be obtained by vibratory motion as shown, for example, in Picone U.S. Pat. No. 2,866,605.

Crushers of this type must often be quite large in relation to the volume of material that can be crushed. The increase in mass provides a corresponding increase in the cost of the crusher and creates inertia problems to the extent that relatively heavy components must be driven or reciprocated during the crushing process. In addition, crushers of the type described above do not have an accurately established upper limit on crushed particle size.

SUMMARY OF THE INVENTION

This invention provides a highly efficient crusher which generally overcomes the disadvantages noted above. With this invention, a substantial mechanical advantage is obtained in the crushing process and this enables small, lightweight units to have relatively high crushing volumes.

These advantages can be obtained, in part, by utilizing a crusher which crushes with a sliding pinch effect rather than by opening and closing jaws or crushing members. With sliding pinch, each of the crushing jaws has a crushing surface and these surfaces are arranged to define an acute angle no larger than about 45 degrees, and the crushing surfaces at least partially define a crushing cavity for receiving the material to be crushed. The jaws are mounted for relative movement along a path generally parallel to the crushing surface of the first jaw. This means that the spacing between the crushing surfaces does not vary with the relative movement of the jaws. This can be contrasted with the prior art crushers which employ movement of the jaws and crushing surfaces toward and away from each other to obtain the crushing action. By relatively moving the jaws along this path, the material in the crushing cavity is crushed between the crushing surfaces.

The jaws are said to be relatively movable along a path because either or both of the two jaws may move, and the only requirement is that such movement results in relative movement or displacement between the two crushing surfaces along the path defined above. At least a component of the path lies in the plane of the acute angle.

Either or both of the two crushing jaws can be moved in any desired manner to achieve relative movement along a path generally parallel to the crushing surface of the first jaw wherein at least a component of the path lies in the plane of the acute angle formed by the crushing surfaces. For example, either or both of the crushing jaws may reciprocate or rotate. However, rotational movement is preferred for several reasons. For example, rotation enables the crushing surfaces to be loaded by centrifugal force rather than gravity, the inertia problems inherent in reciprocation are avoided and the return or non-crushing stroke inherent in reciprocation is also eliminated. Centrifugal loading is preferred to gravity loading because much higher forces can be obtained.

The range of angle formed by the crushing surfaces depends upon the coefficient of sliding friction for the material of the crushing surfaces and the material to be crushed, as well as certain other factors which may be introduced depending upon the particular embodiment of the invention which is utilized. Theoretically, it can be shown that the angle X formed by the two crushing surfaces should be equal to, or less than, arctan f where f is the coefficient of sliding friction between the material to be crushed and the crushing jaws. As a practical matter, the angle should not exceed 45 degrees for any material and it must be greater than zero, i.e., the crushing surfaces should not be parallel. The preferred range is from about 6 degrees to about 16 degrees.

Another advantage of utilizing sliding pinch is that the crushing surfaces can terminate in spaced relationship to define a discharge opening for the crushed material exiting from the crushing cavity. This space between the crushing surfaces at the discharge opening remains substantially unchanged as the jaws are moved relatively along the path. Accordingly, jaw movement does not alter this dimension of the discharge opening so that the upper limit on crushed particle size is positively established without the need for screens or recycling of crushed material.

Choke feeding of a crusher occurs if the crushed particles cannot be discharged from the crushing cavity as rapidly as new material to be crushed is delivered to the crushing cavity. Choke feeding is a common problem in rock crushers and it necessitates placing a limit on how much size reduction can be allowed for any one pass through the crusher. This problem can be eliminated by constructing at least one of the crushing surfaces in the form of a curve with the curve being convex and appropriately shaped to at least assist in preventing choke feeding of the crushing cavity. The curve provides each successive segment extending toward the discharge opening of the crushing cavity with at least as much crushing capacity as the prior segment. This assures that fragments of broken material will always have a sufficient volume to move into as they undergo further movement toward the discharge opening and consequent further size reduction.

In a preferred construction, the crushing surface of the first jaw is essentially planar and the crushing surface of the second jaw is essentially conical. The first and second crushing jaws are mounted for rotation about first and second parallel rotational axes, respectively, with the rotational axes being transverse to the planar crushing surface. The two rotational axes are radially displaced so that a crushing action utilizing the sliding pinch effect is obtained.

The amount of crushing action obtained is a function of the eccentricity of the rotational axes of the crushing jaws. This invention provides for the adjustment in the relative radial position of the rotational axes. This can advantageously be accomplished in response to the rotation of at least one of the crushing jaws.

The lubrication system of this invention is applicable to crushers and other equipment and it insures long bearing life. For example, the crushing jaws may be rotatably mounted by first and second bearings, and one end of the first bearing is supplied with lubricating oil. An oil reservoir is rotated with the first crushing jaw and has inlet passage means for receiving oil from the other end of the bearing. Oil from the first oil reservoir can be conducted to the other bearing by a stationary conduit having an opening within the first oil reservoir. The relative motion between the oil in the reservoir and the stationary conduit provides the pressure for pumping the oil to the second bearing. This process is repeated at the second bearing; however, before being redelivered to the first bearing, the oil can be appropriately cooled.

As this system generates hydraulic pressure, the pressure can be advantageously utilized to perform various different output functions, such as the control of a hydraulic actuator which in turn controls the degree of eccentricity of the two rotational axes. With this arrangement, if the crusher overloads and slows down, the eccentricity automatically and correspondingly diminishes to reduce the crushing action thereby reducing the load on the crusher. Accordingly, overloading of the crusher is automatically compensated for.

The invention, together with further features and advantages thereof, may best be understood by reference to the following description taken in connection with the accompanying illustrative drawing.

DESCRIPTION OF THE PREFERRED EMBODIMENT

Figure 1:
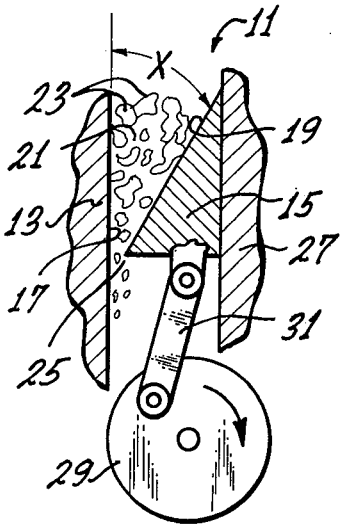
FIG. 1 is a schematic illustration of a reciprocating type of crusher employing the sliding pinch effect.

FIG. 1 shows a crusher 11 for crushing rocks or other materials which generally includes a stationary crushing jaw 13 and a movable crushing jaw 15. The crushing jaws 13 and 15 have planar crushing surfaces 17 and 19, respectively. The crushing surfaces 17 and 19 define an acute angle X which is greater than zero and no larger than about 45°. The crushing surfaces 17 and 19 also define a crushing cavity 21 for receiving material in the form of rocks 23 to be crushed. The crushing surface 17 is vertical, and the crushing surfaces 17 and 19 are spaced apart at the lower end of the crushing surface 19 to define a discharge opening 25 through which the crushed fragments or particles of the rocks 23 can exit the crushing cavity. The crushing surface 17 preferably has a relatively high coefficient of friction, and the crushing surface 19 preferably has a relatively low coefficient of friction.

The crushing jaws 13 and 15 must be relatively moved along a path which is generally parallel to the crushing surface 17 and at least a component of that path must lie in the plane of the acute angle X, i.e., in the plane shown in section in FIG. 1. Although this can be accomplished by moving either or both of the crushing jaws 13 and 15, in the embodiment illustrated, it is accomplished by reciprocating the crushing jaw 15 and holding the crushing jaw 13 stationary. For this purpose, the crushing jaw 15 is suitably guided by a guide 27 for vertical reciprocatory motion, and the crushing jaw 15 is reciprocated by a motor-driven, rotatable crankshaft 29 and a connecting rod 31 pivotally coupled to the crushing jaw 15 and to the crank shaft 29.

The angle X must be small enough so that the rocks 23 do not simply slide upwardly on the vertical crushing surface 17 as the jaw 15 moves upwardly. Assuming that the rocks 23 are gravity fed into the crushing cavity 21, the angle X is preferably no larger than the angle of an incline on which a sample of rock will slide at constant velocity or the angle whose tangent is the coefficient of sliding friction for that particular material. Thus, as materials having lower coefficients of friction are to be crushed, the maximum allowable magnitude of the angle X must be reduced. In practice, the angle X should be greater than zero and no greater than 45 degrees, and the range of from 6 to 16 degrees is considered optimum for most materials.

Figure 1A:
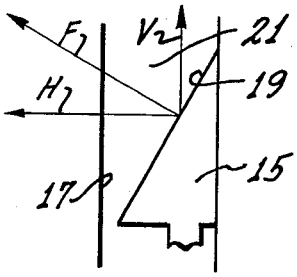
FIG. 1*a* is a schematic illustration of the sliding pinch effect.

As shown in FIG. 1*a*, as the crushing jaw 15 moves upwardly, it exerts a force F against the rocks 23 to be crushed with the force F acting perpendicular to the crushing surface 19. This force F has a horizontal component H and a vertical component V. The product of the horizontal component H and the coefficient of friction (plus the weight of the rocks) tends to hold the rocks 23 in position against the crushing surface 17, and the vertical component V tends to push the rocks 23 upwardly. By appropriately selecting angle X, the product of the horizontal component and the coefficient of friction will exceed the vertical component, and the rocks become pinched between the crushing surfaces 17 and 19 and, therefore, unable to move upwardly. Consequently, as the jaw 15 moves upwardly, it applies a compressive load to the rocks with a significant mechanical advantage which also results from the crushing surface 19 which is in the form of an inclined plane. Accordingly, the rocks 23 are crushed and pass out through the discharge opening 25, the dimensions of which do not vary as the crushing jaw 15 moves upwardly. Of course, the crusher 11 may include one or more sets of the crushing jaws 13 and 15.

Figure 2:
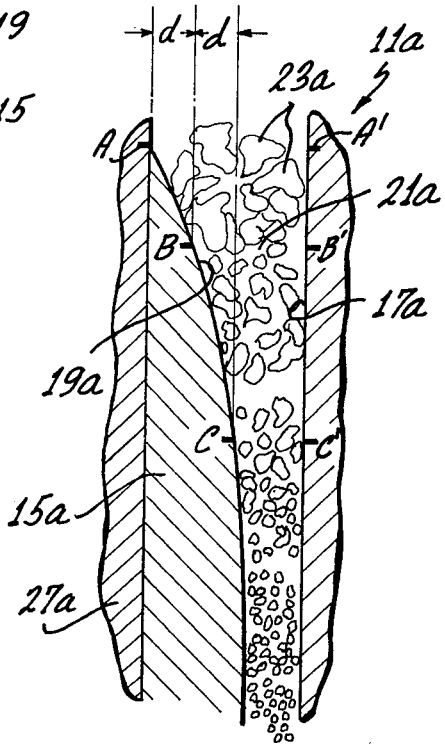
FIG. 2 is a schematic illustration of a reciprocating crusher employing the sliding pinch effect and having one of the crushing surfaces curved to avoid choke feeding.

FIG. 2 shows a crusher 11*a* which is identical to the crusher 11 in all respects, except that the crushing surface 19*a* is curved convexly as it extends toward the crushing surface 17*a*. The crushing surface 19*a* is curved and shaped to prevent choke feeding of the crushing cavity 21*a*. Portions of the crusher 11*a* corresponding to portions of the crusher 11 are designated by corresponding reference numerals followed by the letter "a".

More particularly, the crushing surface 19*a* is curved convexly in such a way as to avoid choke feeding. In moving downwardly along the crushing surface 19*a*, the rocks 23*a* are displaced horizontally a distance d in moving from point A to point B along the crushing surface. In order to be displaced horizontally an additional amount d, those same rocks 23*a* must move downwardly along the crushing surface 19*a* a much greater distance from point B to point C. Thus, the crushing effect obtained in the volume or zone bounded by points A—A′ and B—B′ is equal to the crushing effect obtained in the volume or zone bounded by the points B—B′, C—C′, and the volume of the zone B—B′ C—C′ exceeds, or is at least equal to, the volume of the zone A—A′, B—B′. Thus, the rocks 23*a* are provided with a greater volume for each subsequent increment of crushing effect as the rocks move downwardly along the crushing jaw 19*a*. This increased volume prevents choke feeding and is obtained as a result of utilizing a convex curve on the crushing jaw 19*a*.

Figure 4:
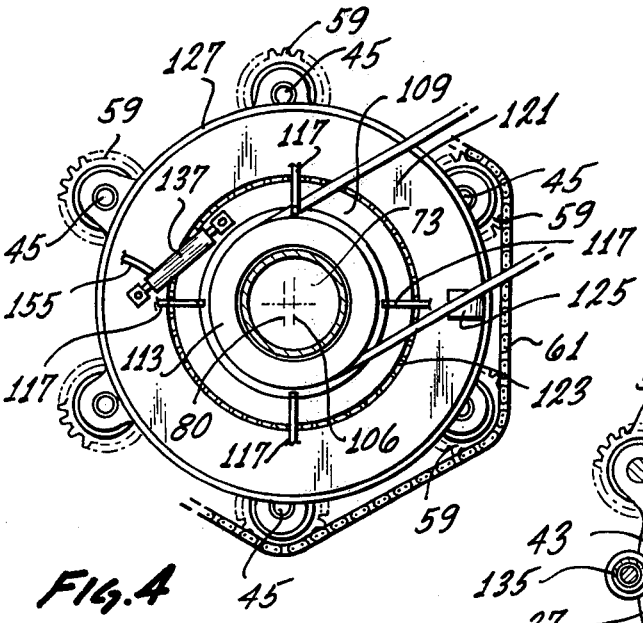
FIG. 4 is a sectional view on a reduced scale taken generally along line 4—4 of FIG. 3.
Figure 5:
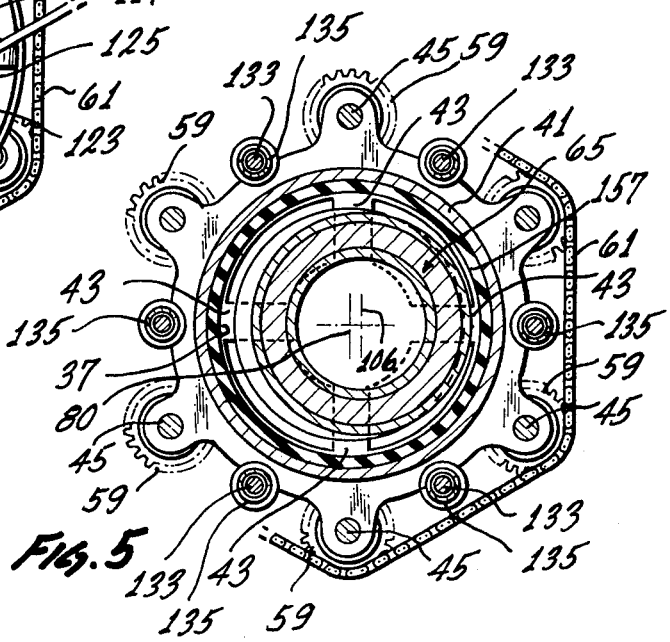
FIG. 5 is a sectional view on a reduced scale taken generally along line 5—5 of FIG. 3.
Figure 3:
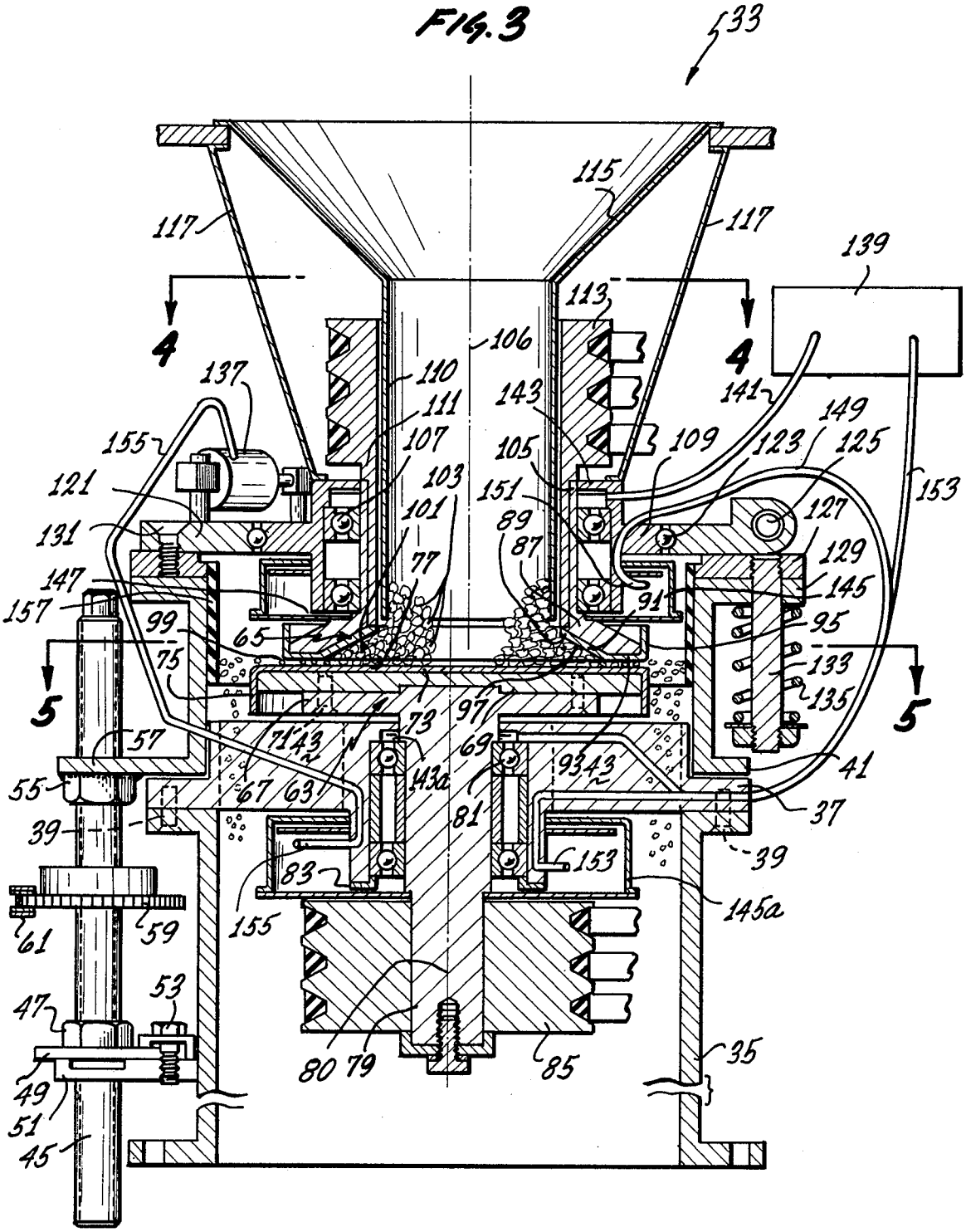
FIG. 3 is a sectional view on an axial plane of a preferred embodiment of crusher constructed in accordance with the teachings of this invention.

FIGS. 3–5 show a crusher 33 which is particularly adapted for crushing rocks. However, the crusher 33 may also be readily adapted to crush other materials, such as grains, coal, certain metals, vegetables, tires, etc. The crusher 33 includes a supporting structure which comprises a tubular base 35 attachable at its lower end to an external supporting member (not shown), a spider 37 suitably attached as by screws 39 to the upper end of the base and an upper tubular shell 41, all arranged in axial alignment. The base 35 houses the lower portion of the crusher 33, and the spider 37 has a plurality of circumferentially spaced radially extending webs 43 (FIGS. 3 and 5).

The shell 41 is adjustably mounted on the base 35 for limited axial movement relative to the shell by a plurality of lead screws 45 (six being illustrated in FIG. 5). Each of the lead screws 45 is coupled to the base 35 by a nut 47 which is suitably rigidly affixed to a platform 49 which is retained on a base plate 51 by a threaded fastener 53. The base plate 51 may be welded or otherwise secured to the base 35.

Each of the screws 45 is coupled to the shell 41 by a nut 55 welded to a flange 57 of the shell 41. Each of the screws 45 has a sprocket 59 rigidly affixed thereto between the nuts 55 and 47 to enable all of the screws to be driven together by a chain 61 (FIG. 5) which is in turn driven by a power source, such as a motor (not shown).

The nuts 47 and 55 are the same hand but have different leads so that rotation of the screws 45 through one turn raises or lowers the shell 41 a distance corresponding to the difference between the leads of the nuts 47 and 55. This permits accurate positioning of the shell 41 axially with respect to the base 35 for purposes explained hereinbelow.

The crusher 33 includes a flat crushing jaw 63 and a conical crushing jaw 65. The flat crushing jaw 63 includes a table 67, a base plate 69 suitably coupled to the table as by screws 71, and a removable liner 73 supported by the base plate 69. The base plate 69 and the table 67 are strong, rigid steel members, and the liner 73 is constructed of a suitable, strong abrasion-resistant metal, such as steel.

In the embodiment illustrated, the liner includes a circular disc which overlies the base plate 69 and an axially short peripheral wall 75 which extends downwardly and surrounds the periphery of the base plate. The liner 73 has an upper surface of circular configuration in plan which defines a planar crushing surface 77 for the crushing jaw 63. The crushing surface 77 in the embodiment illustrated, lies in a radially extending horizontal plane. Although the crushing surface 77 may be roughened and contain irregularities, if desired, in the embodiment illustrated, it is relatively smooth and flat.

The crushing jaw 63 is rotatably mounted, and the force of friction between the base plate 69 and the liner 73 is sufficient to cause the liner 73 to rotate with the base plate. In the embodiment illustrated, an axial shaft 79 integral with the central region of the table 67 extends downwardly from the table and is mounted on the spider 37 for rotation about a first vertically extending rotational axis 80 by a bearing 81. The bearing 81 is suitably mounted on the spider 37 by a strong retainer 83, and a pulley 85 is affixed to the lower end of the shaft 79 to permit the crushing jaw 63 to be rotated by a motor (not shown).

The conical crushing jaw 65 includes a supporting member 87 and a liner 89 which, except for its configuration, may be identical to the liner 73. The liner 89 is essentially cup-shaped and is frictionally retained on the supporting member 87. The liner 89 has a conical section 91, a flat section 93 and a peripheral wall 95 which surrounds the supporting member 87. The conical section 91 defines a conical crushing surface 97 which in more accurate geometric terms is frusto-conical. The flat section 93 is spaced axially from the crushing surface 77 to define an annular, peripheral disharge opening 99. The conical crushing surface 97 cooperates with the flat crushing surface 77 to define a crushing cavity 101 for receiving material, such as rocks 103 to be crushed. As viewed in axial cross section as shown in FIG. 3, the conical crushing surface 97 and the flat crushing surface 77 define an acute angle which should be sized in accordance with the parameters discussed above with reference to FIG. 1 for the angle X. The crushing surface 97 is preferably relatively smooth but it may contain varying degrees of surface irregularities, if desired. If desired, the liner 89 need not be frictionally retained on the member 87, in which event, the centrifugal force of the rocks holds the liner 89 against the member 87.

The supporting member 87 has a tubular extension which defines a tubular shaft 105. The tubular shaft 105 is mounted for rotation about a vertically extending rotational axis 106 by a bearing 107 which is in turn mounted in a circular turntable 109. The conical crushing jaw 65 is rotated by a tubular drive shaft 111 which is received within the tubular shaft 105 and which is drivingly coupled thereto as by splines. The outer end of the drive shaft 111 has a pulley 113 which may be belt driven by the same motor which drives the flat crushing jaw 63.

The rocks 103 or other material to be crushed can be loaded into the crushing cavity 101 by a hopper 115 which is appropriately mounted on the turntable 109 by support members or struts 117. The hopper 115 has a cylindrical extension 119 which is received within the tubular drive shaft 111 and which terminates adjacent the upper end of the liner 89.

In order that the crushing surfaces 77 and 97 can be moved along a path generally parallel to the crushing surface 77 with at least a component of the path lying in the plane of the acute angle formed by these crushing surfaces, the rotational axes of the jaws 63 and 65 should be parallel and radially spaced. To permit varying the eccentricity of the two rotational axes, the bearing 107 mounts the crushing jaw 65 eccentrically within the circular turntable 109, and the turntable is itself mounted for pivotal movement within an upper plate 121 by a bearing 123. Thus, by rotating the turntable 109, the radial spacing between the rotational axes of the crushing jaws 63 and 65 can be varied.

The upper plate 121 is attached at one end by a hinge 125 to an annular plate 127 which rests on an upper flange 129 of the shell 41. The side of the upper plate 121 opposite the hinge 125 is releasably attached to the annular plate 127 in any suitable manner, such as by a screw 131. Accordingly, by removing the screw 131, the upper plate 121 can be pivoted upwardly about the hinge 125 to provide access to the crushing jaws 63 and 65 and to permit the liners 73 and 89 to be replaced and for other work to be performed on the interior regions of the crusher.

The annular plate 127 is resiliently affixed to the shell 41 by a plurality of screws 133 (six being illustrated in FIG. 5) which extend downwardly through openings in the flange 129 as shown in FIG. 3. Each of the screws 133 has a spring 135 which acts between the lower face of flange 129 and the head of the screw to bias the screw and the annular plate 127 downwardly. The springs 135 are very stiff; however, if a piece of iron or other uncrushable material gets between the jaws 63 and 65, the springs 135 can compress to elevate the conical crushing jaw 65 and prevent the crusher from being damaged.

Although various means can be provided for pivoting the turntable 109, in the embodiment illustrated, this is accomplished by a hydraulic actuator 137 (FIGS. 3 and 4). One end of the actuator 137 is mounted on the upper plate 121 and the other end of the actuator is coupled to a peripheral region of the turntable 109. Accordingly, by extending and retracting the actuator 137 in a conventional manner, the turntable 109 can be pivoted about its pivot axis to adjust the relative radial positions of the rotational axes of the crushing jaws 63 and 65. The actuator 137 may be of any type which will position a member in response to hydraulic pressure with the magnitude of the pressure being a known relationship to the position established by the actuator.

To lubricate the bearing 107, lubricating oil is supplied from an oil cooler 139 via a conduit 141 to the upper end of a housing 143 for the bearing 107. The oil is under some pressure and flows downwardly through the bearing 107 into a reservoir 145 which is mounted on the supporting member 87 of the conical crushing jaw 65 and is rotatable therewith. The reservoir 145 has an inlet passage 147 for receiving oil from the lower end of the bearing 107. A conduit in the form of a tube 149 extends into the oil reservoir 145 and has an opening in the form of an open end 151 exposed within the reservoir. Because the tube 149 is stationary and the oil tends to spin with the reservoir 145, oil is scooped in through the open end 151 and is transmitted through the tube 149 to the upper end of a housing **143*a* for the bearing 81. The tube 149 constitutes, in effect, a pitot tube so that the oil is supplied under some pressure to the bearing 81. An oil reservoir 145*a* is mounted on the shaft 79 for rotation therewith. Conduits 153 and 155 lead from the oil reservoir 145*a* to the cooler 139 and the hydraulic actuator 137, respectively. Both of these stationary conduits 153 and 155 have open ends within the reservoir 145*a* to obtain oil under pressure from the reservoir as a result of the spinning of the oil and the reservoir. The pitot tube 153 and the reservoir 145*a* constitute a pump for pumping the oil through the cooler 139**.

The pressure of the hydraulic fluid supplied to the actuator 137 is a function of the angular velocity of the flat crushing jaw 63. Accordingly, if the rate of rotation of the flat crushing jaw 63 is reduced due to an excessively heavy crushing load, the hydraulic pressure transmitted to the actuator 137 is reduced to affect a corresponding reduction in eccentricity of the rotational axes of the jaws 63 and 65. Thus, an overload condition on the crusher 33 tends to be self-correcting.

Material crushed by the crusher 33 moves radially due to centrifugal force out through the discharge opening 99 and is thrown against an annular resilient shock absorber 157 which is suitably attached to the shell 41, but not to the annular plate 127. The crushed material then falls downwardly under the influence of gravity through the openings between the webs 43 of the spider 37 to a collection zone (not shown) located beneath the base 35.

The operation of the crusher 33 should be apparent from the foregoing description. Briefly, however, rocks 103 to be crushed are deposited into the hopper 115 which conveys them downwardly onto the crushing surface 77. With the crushing jaws 63 and 65 rotating, the rocks 103 are forced radially outwardly under the influence of centrifugal force, and the rotation of the flat crushing jaw 63 and the associated oil reservoir **145*a* causes the hydraulic actuator 137*a* to radially displace the rotational axis 106 of the conical crushing jaw 65 from the rotational axis 80 of the flat crushing jaw 63. When the jaws 63 and 65 are not rotating, the axes of rotation 80 and 106 may be coincident, if desired. Due to the rotation of the jaws 63 and 65 about the radially spaced parallel rotational axes 80 and 106, as viewed in an axial plane, such as FIG. 3, the crushing surfaces 77 and 97 move relative to each other along a path parallel to the crushing surface 77. At least a component of this motion is in the plane of the acute angle formed by the crushing surfaces, i.e., the plane of FIG. 3, to crush the rocks 103 with the sliding pinch effect as shown above. Although the crushing jaws 63 and 65** may counter rotate, they are preferably rotated in the same direction.

The crushing jaws 63 and 65 are not moved toward each other, and the vertical dimension of the discharge opening 99 remains constant during operation of the crusher 33. The crushed material is forced through the discharge opening 99 and is thrown against a shock absorber 157 and thereafter falls downwardly to a collection zone. The axial spacing between the crushing surfaces 77 and 97 can be adjusted by rotating the lead screws 45 as discussed above. The springs 135 allow the crushing surfaces 77 and 97 to move axially apart if a piece of uncrushable material gets between the crushing jaws, and by removing the screw 131, the entire upper plate 121 can be moved about its hinge 125 to an open position to provide access to the interior components of the crusher.

Although exemplary embodiments of the invention have been shown and described, many changes, modifications and substitutions may be made by one having ordinary skill in the art without necessarily departing from the spirit and scope of this invention.

I claim:

1. An apparatus for crushing material comprising:

first and second crushing jaws;

each of said jaws having a crushing surface;

said crushing surfaces being inclined relative to each other to define an acute angle no larger than about 45°, said crushing surfaces at least partially defining a crushing cavity for receiving material to be crushed by said crushing jaws;

means for mounting said jaws for relative movement along a path generally parallel to said crushing surface of said first jaw so that said jaws are essentially prevented from moving away from each other during normal operation of the apparatus, at least a component of said path lying in the plane of the acute angle; and means for relatively moving said jaws along said path, said jaws being configured so that the material in said crushing cavity is compressively loaded and crushed by the crushing surfaces of the jaws.

2. An apparatus as defined in claim 1 wherein said moving means includes means for reciprocating one of said jaws.

3. An apparatus as defined in claim 1 wherein said mounting means mounts said second jaw for rotation about a rotational axis which is generally transverse to said crushing surface of said first jaw whereby the crushing surface of said second jaw moves through an arc.

4. An apparatus as defined in claim 1 wherein said acute angle is no less than about 6 degrees and no greater than about 16 degrees.

5. An apparatus as defined in claim 1 wherein said crushing surface of said first jaw is generally planar, said mounting means mounts said first and second jaws for rotation about first and second rotational axes, respectively, and said rotational axes are substantially parallel and generally transverse to the crushing surface of said first jaw.

6. An apparatus as defined in claim 5 including means for varying the radial spacing between said first and second rotational axes.

7. An apparatus as defined in claim 1 wherein said crushing surface of said second jaw terminates in spaced relationship to said crushing surface of said first jaw to define a discharge opening for said crushing cavity, the space between said crushing surfaces at said discharge opening remaining substantially unchanged as said jaws are moved relatively along said path whereby jaw movement does not alter this dimension of the discharge opening.

8. An apparatus as defined in claim 1 wherein at least one of the crushing surfaces defines a curve as it extends toward the other of the crushing surfaces, said curve being convex and shaped to at least assist in preventing choke feeding of the crushing cavity.

9. An apparatus for crushing material comprising:

a supporting structure;

first and second crushing jaws;

said first crushing jaw having a crushing surface;

said second crushing jaw having an essentially conical crushing surface;

first means for mounting the first crushing jaw on the supporting structure for rotation about a first rotational axis;

second mounting means for mounting the second crushing jaw on the supporting structure for rotation about a second rotational axis, said crushing surfaces being in confronting relationship and defining an acute angle in axial cross section, said crushing surfaces defining a crushing cavity for receiving material to be crushed;

said rotational axes being essentially parallel and radially spaced at least during operation of the apparatus, said crushing surfaces being configured so that rotation of the crushing jaws about their respective rotational axes compressively loads and crushes and material in the crushing cavity; and means for retaining the crushing jaws against movement axially away from each other during normal operation of the apparatus.

10. An apparatus as defined in claim 9 including means for loading material to be crushed into the crushing cavity through a central region of the second crushing jaw.

11. An apparatus as defined in claim 9 including means responsive to the rotation of at least one of the crushing jaws for varying the relative radial position of the first and second rotational axes.

12. An apparatus as defined in claim 9 wherein one of said first and second mounting means includes a table, means for rotatably mounting the table on the supporting structure for pivotal movement about a first pivot axis, and means for mounting the associated crushing jaw on the table for rotation about its rotational axis, the rotational axis of said associated crushing jaw being eccentric relative to the first pivot axis whereby pivotal motion of the table about the first pivot axis adjusts the relative radial position of the first and second rotational axes.

13. An apparatus as defined in claim 9 wherein said crushing surface of said first crushing jaw is essentially planar and said rotational axes are transverse to the planar crushing surface, said conical crushing surface terminates in spaced relationship to said planar crushing surface to define a discharge opening for said crushing cavity at the large diameter end of said conical crushing surface.

14. An apparatus as defined in claim 9 wherein one of said mounting means includes a bearing, said apparatus includes an oil reservoir driven with the crushing jaw associated with said one mounting means, means for supplying lubricating oil to one end of said bearing, said oil reservoir having inlet passage means for delivering oil from the other end of said bearing to said oil reservoir, and a conduit opening in said reservoir for receiving oil from the reservoir as a result of relative motion between the reservoir to thereby provide oil under pressure in the conduit.

15. An apparatus as defined in claim 9 wherein the supporting structure includes a support member, a first plate, means for resiliently mounting the first plate on the support member, a second plate and hinge means for mounting the second plate on the first plate for hinged movement relative to the first plate, said second mounting means being carried by said second plate.

16. An apparatus as defined in claim 9 wherein said first crushing jaw includes a rotatable support member and a liner frictionally driven by said rotatable support member, said liner defining said crushing surface of said first jaw whereby said liner can be easily removed from said rotatable support member.

17. A method of crushing material comprising:

providing first and second crushing jaws with each of the crushing jaws having a crushing surface and with the crushing surfaces being inclined relative to each other to define an acute angle no larger than about 45 degrees, said crushing surfaces at least partially defining a crushing cavity;

depositing material to be crushed into the crushing cavity; and relatively moving the jaws along a path generally parallel to said crushing surface of said first jaw to maintain the spacing between the crushing surfaces essentially constant as the jaws are relatively moved and to compressively load and crush material deposited in the crushing cavity.

18. A method as defined in claim 17 wherein said step of moving includes reciprocating at least one of said crushing jaws.

19. A method as defined in claim 17 wherein said step of moving includes rotating both of said jaws about non-concentric, parallel axes.

20. An apparatus for crushing material comprising:

a supporting structure;

first and second crushing jaws;

said first crushing jaw having a crushing surface;

said second crushing jaw having an essentially conical crushing surface;

first means for mounting the first crushing jaw on the supporting structure for rotation about a first rotational axis;

second mounting means for mounting the second crushing jaw on the supporting structure for rotation about a second rotational axis, said crushing surfaces being in confronting relationship and defining an acute angle in axial cross section, said crushing surfaces defining a crushing cavity for receiving material to be crushed;

said rotational axes being essentially parallel and radially spaced whereby rotation of the crushing jaws about their respective rotational axes crushes the material in the crushing cavity; and an oil reservoir driven with one of said crushing jaws for receiving oil for lubricating at least one of the mounting means, a conduit opening in said reservoir for receiving oil from the reservoir as a result of relative motion between the reservoir and the conduit, and means responsive to the oil in the conduit for varying the relative radial position of the first and second rotational axes.

21. An apparatus for crushing material comprising:

a supporting structure;

first and second crushing jaws;

said first crushing jaw having a crushing surface;

said second crushing jaw having an essentially conical crushing surface;

first means for mounting the first crushing jaw on the supporting structure for rotation about a first rotational axis;

second mounting means for mounting the second crushing jaw on the supporting structure for rotation about a second rotational axis, said crushing surfaces being in confronting relationship and defining an acute angle in axial cross section, said crushing surfaces defining a crushing cavity for receiving material to be crushed;

said rotational axes being essentially parallel and radially spaced whereby rotation of the crushing jaws about their respective rotational axes crushes the material in the crushing cavity; and means responsive to the rotation of at least one of the crushing jaws for varying the relative radial position of the first and second rotational axes.

* * * * *